US005651268A

United States Patent [19]

Aikawa et al.

[11] Patent Number: 5,651,268

[45] Date of Patent: Jul. 29, 1997

[54] REFRIGERANT EVAPORATOR

[75] Inventors: Yasukazu Aikawa, Nagoya; Yoshiharu Kajikawa, Hekinan; Toshio Ohara, Kariya, all of Japan

[73] Assignee: Nippondeso Co., Ltd., Kariya, Japan

[21] Appl. No.: 580,651

[22] Filed: Dec. 29, 1995

[30] Foreign Application Priority Data

Jan. 5, 1995 [JP] Japan ..... 7-000400

[51] Int. Cl.[6] ..... F25B 39/02; F28F 9/02

[52] U.S. Cl. ..... 62/525; 165/174; 138/44

[58] Field of Search ..... 62/525, 527; 165/174, 165/DIG. 483; 138/44

[56] References Cited

U.S. PATENT DOCUMENTS

| | | | |
|---|---|---|---|
| 3,976,128 | 8/1976 | Patel et al. | 165/174 X |
| 4,524,823 | 6/1985 | Hummel et al. | 62/527 X |

FOREIGN PATENT DOCUMENTS

| | | | |
|---|---|---|---|
| 6159983 | 6/1994 | Japan | 165/174 |
| 2250336 | 6/1992 | United Kingdom | 165/174 |
| 2250336 | 7/1994 | United Kingdom . | |

*Primary Examiner*—William E. Wayner
*Attorney, Agent, or Firm*—Harness, Dickey & Pierce

[57] ABSTRACT

An evaporator capable of improving heat-exchange efficiency by enhancing performance to distribute refrigerant to many refrigerant passages of a refrigerant distribution pipe from a throttle. The evaporator is capable of suppressing the occurrence of a refrigerant passing noise by the throttle while maintaining the throttle of a nozzle at a certain size as to be able to function as a throttle. The inner diameter of the throttle in the nozzle is made as large as possible. The cross-sectional center of the throttle of the nozzle is off-centered toward the upper side relative to the cross-sectional center of the refrigerant distribution pipe inserted into the inlet tank of the evaporator. The refrigerant flows out of the throttle in a mixed condition of liquid and gas, and separation of gas and liquid in the refrigerant is alleviated inside the refrigerant distribution chamber. The refrigerant flowing out of the throttle of the nozzle can easily flow into the upper side of the refrigerant distribution pipe rather than the lower side. Thus, the performance of refrigerant distribution from the throttle to many refrigerant passages of the refrigerant distribution pipe is improved.

10 Claims, 12 Drawing Sheets

REFRIGERANT EVAPORATOR

CROSS REFERENCE TO RELATED APPLICATIONS

This application is based upon and claims priority from Japanese Patent Application No. 7-400 filed on Jan. 5, 1995 incorporated herein by reference.

BACKGROUND OF THE INVENTION

1. Field of the Invention

The present invention relates to a refrigerant evaporator which composes a refrigerant cycle of an air conditioner incorporating a refrigerant compressor and a refrigerant condenser.

2. Description of Related Art

As for air blowing from a refrigerant evaporator, uniformity of air blow temperature distribution has been recently demanded. To achieve this purpose, a method to distribute refrigerant evenly to plural refrigerant evaporation passages is available. One of such refrigerant evaporators is disclosed in Japanese Patent Application Laid-Open No. 4-155194 hereafter referred to as "App. No. 4-155194", in which refrigerant flows into plural refrigerant passages formed inside the refrigerant evaporator. A refrigerant distribution pipe evenly distributes the refrigerant to plural refrigerant evaporation passages respectively, and a round-shaped throttle hole is disposed upstream of the refrigerant distribution pipe to create a liquid-gas mixed condition even with respect to the cross-section of the passages.

In the prior art, however, because the throttle causes a refrigerant passing noise, the size of the throttle should not be excessively small. Mainly due to gravitation, the gas ingredient flows in the refrigerant passage at the upper side of the refrigerant distribution pipe while liquid ingredient flows in the refrigerant passage at the lower side of the refrigerant distribution pipe. Thus, the refrigerant flow is separated. It has been impractical to distribute the refrigerant evenly inside the plural refrigerant passages of the refrigerant distribution pipe.

The farther the refrigerant goes from the inlet side to the back side of the plural refrigerant evaporation passages, the more difficult it is for the liquid refrigerant to flow. The closer the refrigerant comes to the inlet side, the more difficult it is for the liquid refrigerant to flow. Therefore, cooling performance between the air passing around the refrigerant evaporation passage at the inlet side and the air passing around the refrigerant evaporation passage at the back side differs, and blow temperature of the air passing around the refrigerant evaporation passage at the inlet side and blow temperature of the air passing around the refrigerant evaporation passage at the back side vary, which causes uneven distribution of blow temperature.

SUMMARY OF THE INVENTION

A purpose of the present invention is to provide a refrigerant evaporator which can suppress a refrigerant passing noise by the throttle and which can improve heat exchange efficiency by enhancing performance of refrigerant distribution from the throttle to the plural refrigerant passages of the refrigerant distribution pipe.

Another purpose of the present invention is to provide a refrigerant evaporator which can suppress deterioration of blow temperature distribution by eliminating the temperature difference between the blow temperature of the air passing around the refrigerant evaporation passages at the inlet side and the blow temperature of the air passing around the refrigerant evaporation passages at the back side, even if a heat carrier is air.

According to a first preferred embodiment of the present invention, an inlet tank into which the refrigerant flows extends from the inlet side to the back side of the evaporator. Plural refrigerant evaporation passages are connected in parallel from the inlet side to the back side of the inlet tank. Heat-exchange of the refrigerant flowing in from the inlet tank occurs with such a heat carrier as air or water to evaporate the refrigerant. A refrigerant distribution pipe is inserted from the inlet side to the back side of the inlet tank and has plural refrigerant passages to distribute the refrigerant flowing inside to the plural refrigerant evaporation passages respectively. A throttle, in the shape of a circle, an oval, or a horizontally-oblong circle, is disposed at the upstream side of the refrigerant distribution pipe. The center of the throttle is off-centered from the center of the refrigerant distribution pipe toward the outer diameter. The eccentric direction of the throttle relative to the center of the refrigerant distribution pipe can be not only an upper direction but also an obliquely upper direction. According to this embodiment, refrigerant flowing out of the throttle flows into the plural refrigerant passages of the refrigerant distribution pipe inserted inside the inlet tank. The inner diameter of the throttle cannot be made excessively small since it causes a refrigerant passing noise to occur. Due to gravitation, gas phase ingredient tends to go to the upper side of the refrigerant distribution pipe while liquid phase ingredient tends to go to the lower side of the refrigerant distribution pipe. Thus, the refrigerant in two-phase condition of liquid and gas tries to separate from each other. However, since the center of the throttle is off-centered from the center of the refrigerant distribution pipe toward the outer diameter, separation of liquid and gas refrigerant in the inlet of the plural refrigerant passages of the refrigerant distribution pipe is alleviated, and the refrigerant flows evenly into each of the plural refrigerant passages of the refrigerant distribution pipe.

Accordingly, distribution performance of the refrigerant to the plural refrigerant passages of the refrigerant distribution pipe from the throttle can be much improved, so that the refrigerant can evenly flow into all the refrigerant evaporation passages from the inlet side to the back side of the inlet tank. There will be a smaller difference in heat exchange performance between the heat carrier passing around the refrigerant evaporation passages connected to the inlet side of the inlet tank and the heat carrier passing around the refrigerant evaporation passage connected to the back side of the inlet tank. Heat exchange efficiency of the refrigerant evaporator as a whole can be also improved. Furthermore, a refrigerant passing noise by the throttle can be suppressed while maintaining the throttle at a certain size.

An additional embodiment of the present invention is characterized by plural outlet holes disposed on the refrigerant distribution pipe. The plural outlet holes are formed one after the other from the upper to the lower part of the refrigerant distribution pipe from the inlet side to the back side of the inlet tank, and make the refrigerant flow out to each of the plural refrigerant evaporation passages from the plural refrigerant passages.

According to a further embodiment of the present invention, an inlet tank with the refrigerant flowing therein extends from the inlet side to the back side. Plural refrigerant evaporation passages are connected in parallel from the inlet side to the back side of the inlet tank, and heat-exchange the refrigerant flowing in from the inlet tank with such a heat carrier as air or water to evaporate the refrigerant. A refrigerant distribution pipe is inserted from the inlet side to the back side of the inlet tank and has plural refrigerant passages to distribute the refrigerant flowing inside to the plural refrigerant evaporation passages respectively. A throttle, in a shape of a substantially horizontally-oblong circle, is disposed at the upstream side of the refrigerant distribution pipe. Throttle amount can be reduced even in the same cross-sectional area compared with a circle-shaped throttle. In the gravitation direction, gas and liquid refrigerant is evenly mixed and such condition can be maintained so that the refrigerant can evenly flow into each of the plural refrigerant passages of the refrigerant distribution pipe.

An additional embodiment of the present invention is characterized by plural outlet holes disposed on the refrigerant distribution pipe. The plural outlet holes are formed one after the other from the upper to the lower part of the refrigerant distribution pipe from the inlet side to the back side of the inlet tank. The plural outlet holes make the refrigerant flow out to each of the plural refrigerant evaporation passages from the plural refrigerant passages.

According to a further embodiment of the present invention, an inlet tank with the refrigerant flowing therein extends from the inlet side to the back side. Plural refrigerant evaporation passages are connected in parallel from the inlet side to the back side of the inlet tank, and heat-exchange the refrigerant flowing in from the inlet tank with a heat carrier to evaporate the refrigerant. A refrigerant distribution pipe is inserted from the inlet side to the back side of the inlet tank and has plural refrigerant passages to distribute the refrigerant flowing inside to the plural refrigerant evaporation passages respectively. A throttle is disposed at the upstream side of the refrigerant distribution pipe. The refrigerant evaporator has a distribution chamber between the throttle and the plural refrigerant passages. The distribution chamber is inclined toward the upper part from the lower part of the refrigerant distribution pipe. Therefore refrigerant flowing out of the throttle can easily flow into the refrigerant passages at the upper side of the refrigerant distribution pipe rather than into the refrigerant passages at the lower side of the refrigerant distribution pipe.

In addition to the refrigerant evaporator of the various above-described embodiments, a further embodiment of the invention according to claim 7 is characterized by plural outlet holes disposed on the refrigerant distribution pipe. The plural outlet holes are formed one after the other from the upper to the lower part of the refrigerant distribution pipe from the inlet side to the back side of the inlet tank. The plural outlet holes make the refrigerant flow out to each of the plural refrigerant evaporation passages from the plural refrigerant passages.

According to an additional embodiment of the present invention, an inlet tank with refrigerant flowing therein extends from the inlet side to the back side. Plural refrigerant evaporation passages are connected in parallel from the inlet side to the back side of the inlet tank, and heat-exchange the refrigerant flowing in from the inlet tank with a heat carrier to evaporate the refrigerant. A refrigerant distribution pipe is inserted from the inlet side to the back side of the inlet tank and has plural refrigerant passages to distribute the refrigerant flowing inside to the plural refrigerant evaporation passages respectively. A throttle is disposed at the upstream side of the refrigerant distribution pipe. The plural outlet holes of the refrigerant distribution pipe are disposed one after the other from the upper to the lower part of the refrigerant distribution pipe from the inlet side to the back side of the inlet tank. Naturally, the length of the refrigerant passage at the lower side of the refrigerant distribution pipe becomes longer than the refrigerant passage at the upper side of the refrigerant distribution pipe, which causes a bigger pressure loss in the refrigerant passage at the lower side of the refrigerant distribution pipe than in the refrigerant passage at the upper side of the refrigerant distribution pipe. A large amount of the refrigerant having a relatively high dryness fraction flows into the refrigerant passage at the upper side of the pipe while a small amount of refrigerant having a relatively low dryness fraction flows into the refrigerant passage at the lower side of the pipe. That is, a large amount of high dryness refrigerant and a small amount of low dryness refrigerant flow into the refrigerant passage. Consequently, the flowing amount of liquid refrigerant becomes even as a whole.

In addition, a straight refrigerant distribution pipe may be incorporated which can be easily manufactured and can improve the distribution of the refrigerant.

Technical means to dispose plural outlet holes on the refrigerant distribution pipe is adopted. The plural outlet holes are formed one after the other from the upper to the lower part of the refrigerant distribution pipe from the inlet side to the back side of the inlet tank. The plural outlet holes make the refrigerant flow out to each of the plural refrigerant evaporation passages from the plural refrigerant passages.

Other objects and features of the invention will appear in the course of the description thereof, which follows.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF THE PREFERRED EMBODIMENTS

The refrigerant evaporator according to the present invention will be described hereafter with reference to embodiments applied to a refrigerant evaporator of an automotive air conditioner.

Figure 1:
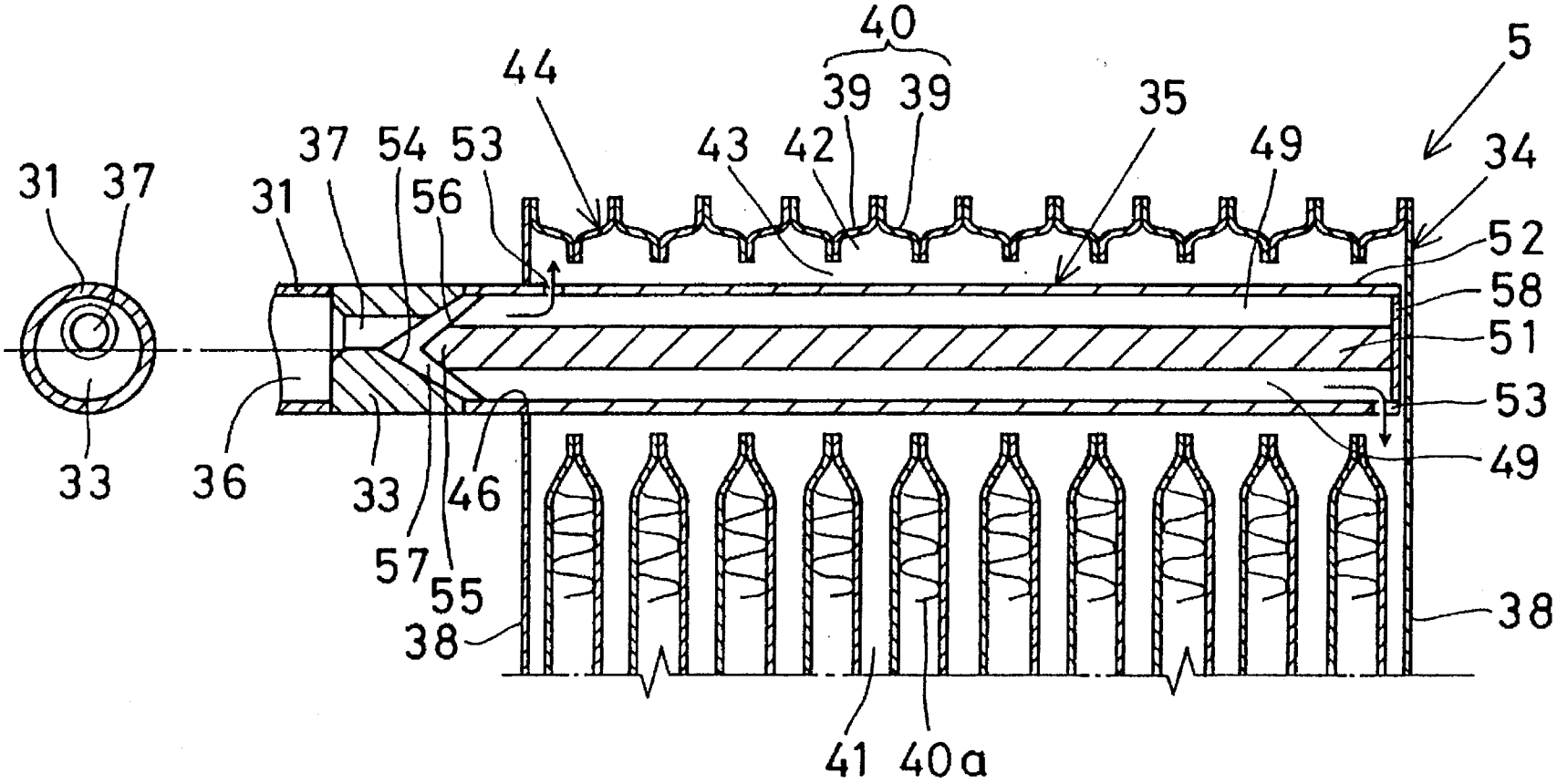
FIG. 1 is a cross-sectional view of a main part of an evaporator used in a first embodiment of the present invention.
Figure 2:
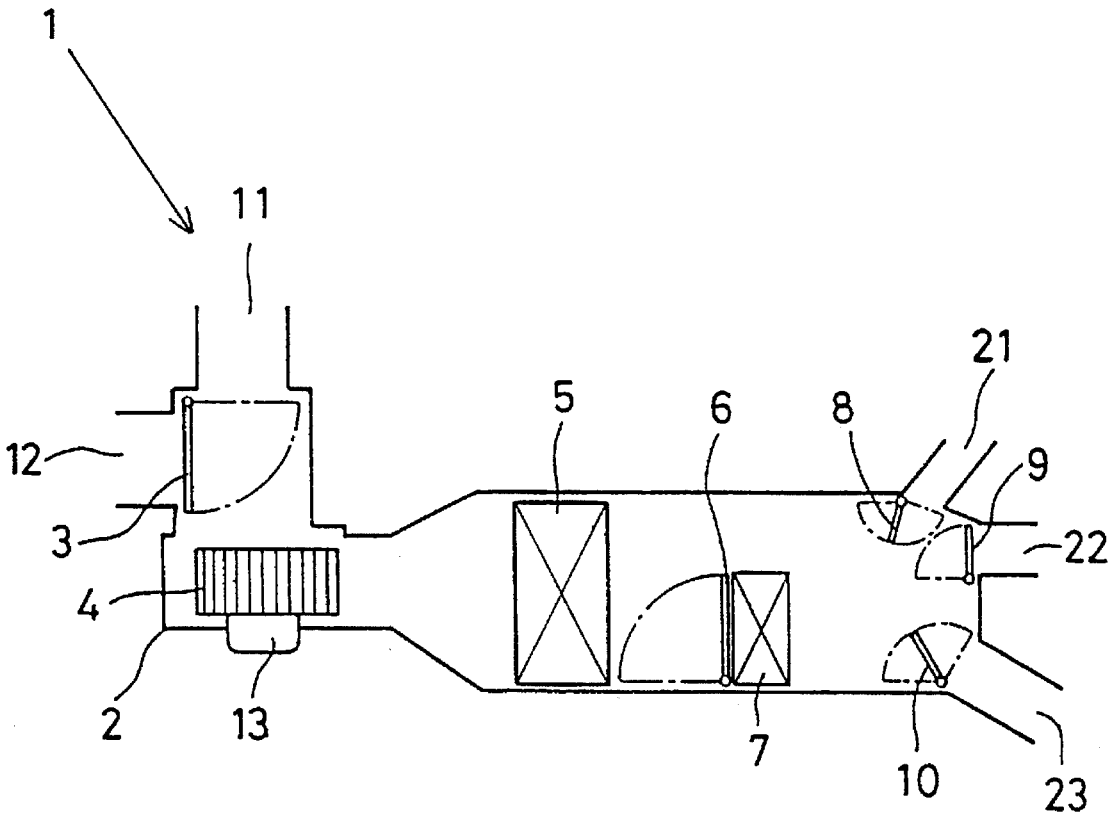
FIG. 2 is a schematic view of a duct of an automotive air conditioner used in the first embodiment of the present invention.
Figure 3:
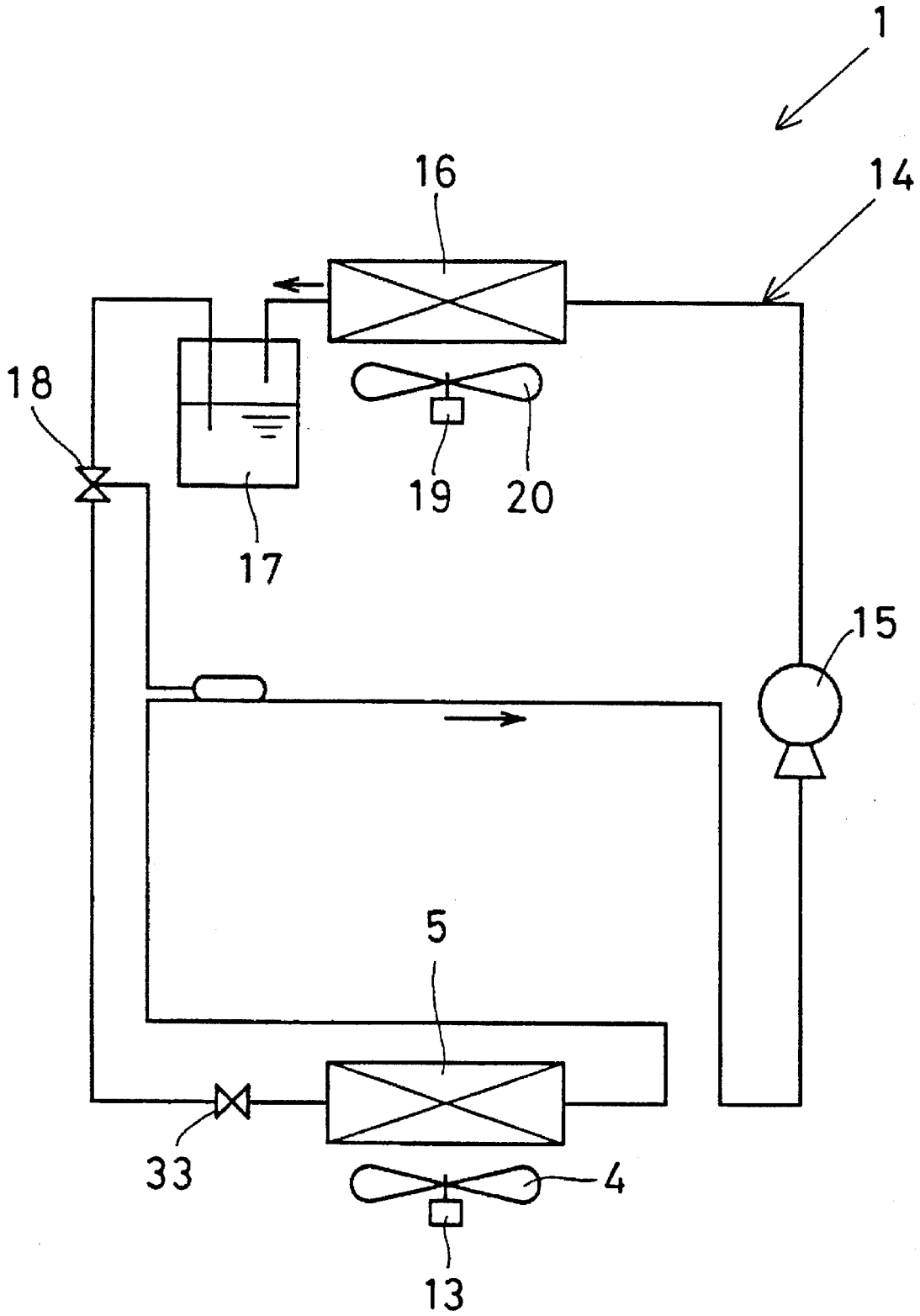
FIG. 3 is a construction view of a refrigerant cycle of the automotive air conditioner used in the first embodiment of the present invention.

FIG. 1 shows a main part of an evaporator according to a first embodiment of the present invention. FIG. 2 shows a dust structure of an automotive air conditioner. FIG. 3 shows a refrigerant cycle of an automotive air conditioner.

An automotive air conditioner 1 has a duct 2 fixed on the front side of a compartment. In duct 2, an inside/outside air switching damper 3, a blower 4, an evaporator 5, an air mixing damper 6, a heater core 7, a defrost damper 8, a face damper 9 and a foot damper 10 are installed from upwind to downwind.

Inside/outside air switching damper 3 is actuated by one of several actuating means such as a servomotor. Damper 3 switches between an outside air inlet mode to introduce outside air from an outside air intake port 11 of duct 2 and an inlet switching mode such as an inside air circulation mode to introduce inside air from an inside air intake port 12.

Blower 4 is rotatably actuated by a blower motor 13 as actuating means. Blower 4 may be any of several means to blow air such as a centrifugal blower which generates air current flowing to the compartment via evaporator 5 and heater core 7 inside duct 2.

Evaporator 5 is a refrigerant evaporator of the present invention and is a laminated-type refrigerant evaporator of a so-called refrigerant cycle 14. Evaporator 5 cools air sent by blower 4 based on the operation of refrigerant cycle 14. As shown in FIG. 3, refrigerant cycle 14 has a compressor 15, a condenser 16, a receiver 17, a thermostatic expansion valve (hereafter called an expansion valve) 18 and other components in addition to evaporator 5.

Refrigerant cycle 14 starts when rotational force of an engine (not shown) is transmitted to compressor 15 by supplying electricity to activate an electromagnetic clutch (not shown) of compressor 15. As actuating means for compressor 15, an electric motor can be used instead of an engine.

Compressor 15 discharges high temperature and high pressure gas refrigerant after compressing the incoming refrigerant. Condenser 16 condenses and liquifies the refrigerant by heat-exchanging the outside air blown by a cooling fan 20 with high temperature and high pressure gas refrigerant. Fan 20 is rotatably actuated by a fan motor 19. Receiver 17 receives refrigerant and functions as a gas-liquid separator to supply only liquid refrigerant to expansion valve 18 after separating gas refrigerant from liquid refrigerant.

Expansion valve 18 automatically regulates reduced pressure amount and refrigerant circulation amount to exhibit the maximum cooling capacity of evaporator 5, and, for example, keeps overheat amount constant at the outlet side of evaporator 5 so as to finish evaporation of the refrigerant at the outlet side of evaporator 5.

Air mixing damper 6 is rotatably installed at the upwind side of heater core 7. Air mixing damper 6 is actuated by actuating means such as a servomotor, and adjusts the amounts of air passing through heater core 7 and air bypassing heater core 7 in accordance with opening degree thereof. Heater core 7 heats air, which has passed evaporator 5, according to cooling water temperature from the cooling water circuit of an engine installed in a vehicle, and moves the air toward defrost damper 8, face damper 9 and foot damper 10.

Defrost damper 8, face damper 9 and foot damper 10 are rotatably installed at the downwind side of duct 2, and are respectively actuated by actuating means such as a servomotor. Defrost damper 8, face damper 9 and foot damper 10 open or close a defroster air outlet 21, face air outlet 22 and a foot air outlet 23 placed at the most downstream portion of duct 2.

Figure 4:
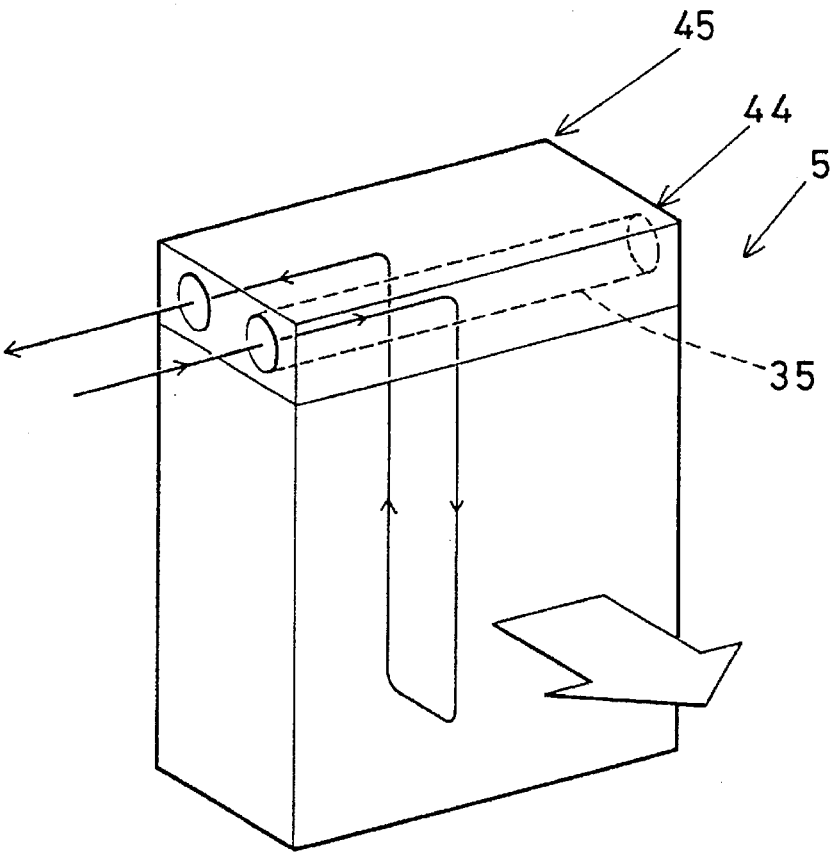
FIG. 4 is a perspective view shown in partial section of the flow of refrigerant inside the evaporator used in the first embodiment of the present invention.
Figure 5:
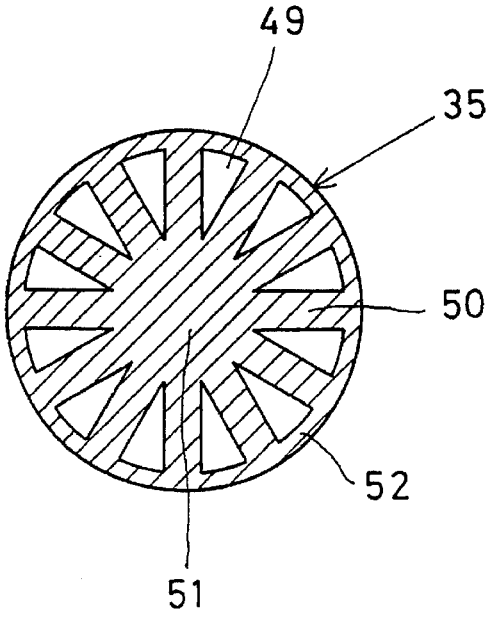
FIG. 5 is a cross-sectional view of a refrigerant distribution pipe used in the first embodiment of the present invention.

Detail of evaporator 5 will now be described with reference to FIGS. 1, 4 and 5. Evaporator 5 includes an inlet pipe 31, an outlet pipe, a nozzle 33, evaporator body 34, a refrigerant distribution pipe 35, and so forth. Evaporator 5 comprises a cooling unit with the unit case of duct 2.

Inlet pipe 31 has refrigerant passage 36 formed therein to flow the refrigerant into evaporator 5 from expansion valve 18. Refrigerant passage 36 is cylindrically-shaped. The outlet pipe makes the refrigerant flow from evaporator 5 to compressor 15 and is also cylindrically-shaped.

Nozzle 33 is a throttle of the present invention and has a circular throttle hole (the inner diameter is 4 mm) formed therein. By throttling a passage area from inlet pipe 31 to refrigerant distribution pipe 35, nozzle 33 reduces pressure of the refrigerant passing a throttle hole 37. In this embodiment, as shown in FIG. 1, the relationship between eccentricity amount e of the cross-sectional center of throttle hole 37 relative to the cross-sectional center of refrigerant distribution pipe 35 and the inner diameter d of throttle hole 37 is determined by the equations and inequalities 1 and 2.

Equation and inequality 1

$3\ \text{mm} \leqq d \leqq 7\ \text{mm}$

Equation and inequality 2

$0.3\ \text{mm} \leqq e \leqq 1.5\ \text{mm}$

In evaporator body 34, thin plural molded plates 39 in the same shape are laminated in the width direction (horizontally) between two end plates 38. Molded plates 39 are laminated at the intervals of 150 mm–350 mm, with the front of a plate facing the back of next plate. Two end plates 38 and plural molded plates 39 are connected to each other by welding or brazing. One pair of molded plates 39 placed next to each other defines a refrigerant passage pipe (tube) 40. A substantially "U" shaped refrigerant evaporation passage 41 is formed like a shallow dish on the opposite-facing welded surfaces of a pair of molded plates 39. Refrigerant evaporation passage 41 heat-exchanges the refrigerant and the air to evaporate the refrigerant to cool the air. By laminating plural refrigerant passage pipes 40 horizontally, plural refrigerant evaporation passages 41 can be horizontally formed. A corrugated fin 40*a* is welded by braising and so forth between adjacent refrigerant passage pipes 40 to improve heat exchange efficiency with the refrigerant and the air.

An inlet tank portion 42 and an outlet tank portion (not shown) shaped like a bowl are unitedly molded at the top of one pair of molded plates 39. Inlet tank portion 42 communicates with the inlet portion of plural refrigerant evaporation passages 41 while outlet tank portion (not shown) communicates with the outlet portion of plural refrigerant evaporation passages 41.

Plural inlet tank portions 42 are divided by a partition wall which has a circular communicating hole (a penetrating hole) 43 to communicate with an adjacent pair of molded plates 39 and to insert refrigerant distribution pipe 35. The inner periphery of the partition wall of inlet tank portion 42 may be connected to the outer periphery of refrigerant distribution pipe 35.

Plural outlet tank portions are also divided by a partition wall. A circular communicating hole (a penetrating hole) is formed on the partition wall of the outlet tank portion to communicate with an adjacent pair of molded plates 39 and the refrigerant passage of the outlet pipe.

By combining plural inlet tank portions 42 with each other in the laminated direction (horizontal direction) of molded plates 39, one inlet tank 44 is created on the upwind (or downwind) side at the top of plural refrigerant evaporation passages 41. The refrigerant flows into inlet tank 44 from refrigerant distribution pipe 35. Similarly, by combining plural outlet tank portions with each other in the laminated direction (horizontal direction) of molded plates 39, one outlet tank 45 is created on the downwind (or upwind) side at the top of plural refrigerant evaporation passages 41. The refrigerant flows into outlet tank 45 from refrigerant evaporation passage 41. End plate 38 at the inlet side of inlet tank 44 has a circular penetrating hole 46.

Refrigerant distribution pipe 35 is connected to nozzle 33 by welding or brazing. Refrigerant distribution pipe 35 has many holes and is inserted from the inlet side of inlet tank 44 to the back side (outlet side) to penetrate communicating hole 43 and a penetrating hole 46. Refrigerant distribution pipe 35 has as many refrigerant passages 49 as refrigerant evaporation passages 41 and inlet tank portions 42 therein. Plural refrigerant passages 49 are means to distribute the refrigerant evenly to each of plural refrigerant evaporation passages 41 and plural inlet tank portions 42 after the refrigerant flows out of throttle hole 37.

Each refrigerant passage 49 is divided by a partition wall 50. A shaft portion 51 having a circular cross-section is disposed in refrigerant passage 49. An outer peripheral wall 52 having a ring like cross-section is formed at the outside of plural refrigerant passages 49. Circular outlet holes 53 are bored on outer periphery wall 52 at a predetermined interval to communicate with each refrigerant passage 49 and each refrigerant evaporation passage 41.

A conical convex portion 55 is formed at the inlet side of refrigerant distribution pipe 35. A conical concave portion 54 is formed at the outlet end of nozzle 33. Convex portion 55 is engaged with concave portion 54. The conical surface of convex portion 55 has an inlet hole 56 of plural refrigerant passages 49. An umbrella-shaped refrigerant distribution chamber 57 is formed between convex portion 55 of refrigerant distribution pipe 35 and the outlet end of nozzle 33 to distribute the refrigerant flowing out of throttle hole 37 evenly into each refrigerant passage 49. A disk-shaped cap 58 is fixed in the opening portion at the back side of refrigerant distribution pipe 35 by welding or brazing.

Operation of automotive air conditioner 1 according to this embodiment will be briefly described with reference to FIG. 1 or 4. When an engine starts to supply electricity to an electromagnetic clutch of compressor 15, the rotational force of the engine is transmitted to compressor 15 via the electromagnetic clutch. This causes compressor 15 to take in the refrigerant from an intake port to start compression.

The refrigerant is compressed by compressor 15 to be high temperature and high pressure gas refrigerant and is discharged from a discharging port to flow into condenser 16. The gas refrigerant flowing into condenser 16 is deprived of heat by the outside air blown by cooling fan 20 when passing condenser 16 and is cooled, condensed, and liquified. The liquid refrigerant flowing out of condenser 16 flows into receiver 17 to separate gas and liquid. The only liquid refrigerant is supplied to expansion valve 18.

After reaching expansion valve 18, the pressure of liquid refrigerant is reduced while the refrigerant is passing through expansion valve 18, and the refrigerant becomes gas and liquid mixed condition (a two-phase condition of gas refrigerant and liquid refrigerant), which passes inlet pipe 31 to flow into throttle hole 37 of nozzle 33. The pressure is further reduced when the refrigerant passes throttle hole 37. Thus, the refrigerant further cooled has a high dryness fraction with plenty of gas ingredient (gas-rich refrigerant), and flows out of throttle hole 37 to flow into refrigerant distribution chamber 57.

After the refrigerant with a two-phase condition of gas and liquid flows into refrigerant distribution chamber 57, the refrigerant flows into plural refrigerant passages 49 formed in refrigerant distribution pipe 35 inserted in inlet tank 44 of evaporator 5. Because the cross-sectional area of throttle hole 37 causes occurrence of a refrigerant passing noise, the size of throttle hole 37 should not be excessively small. The refrigerant flows in the cross sectional portion of throttle hole 37 and in refrigerant distribution chamber 57 between the outlet of throttle hole 37 and the inlet of refrigerant distribution pipe 35. Due to gravitation, gas-rich refrigerant with high dryness fraction flows in the upper part of refrigerant distribution chamber 57 while liquid-rich refrigerant with low dryness fraction flows in the lower part of refrigerant distribution chamber 57. Thus, the refrigerant is separated into gas and liquid to flow into many refrigerant passages 49 of refrigerant distribution pipe 35.

In this embodiment, the cross sectional center of throttle hole 37 is off-centered in the upper direction from the cross-sectional center of refrigerant distribution pipe 35 when d is the inner diameter and e is eccentricity amount of throttle hole 37 relative to the cross-sectional center of refrigerant distribution pipe 35, so that the inner diameter d and the eccentricity amount e have a relationship of $3\text{mm} \leqq d \leqq 7$ mm, and $0.3\text{ mm} \leqq e \leqq 1.5$ mm.

Umbrella-shaped refrigerant distribution chamber 57 is formed between conical convex portion 55 at the inlet side of refrigerant distribution pipe 35 and a conical concave portion 54 at the outlet end of nozzle 33. The cross-sectional center of throttle hole 37 is off-centered in the upper direction from the edge of convex portion 55. For this reason, the refrigerant flowing out of throttle hole 37 tends to flow to the upper part of refrigerant distribution pipe 35 rather than to the lower part thereof. Since separation of gas and liquid in the refrigerant inside refrigerant distribution chamber 57 is alleviated, the refrigerant comes to flow evenly into refrigerant passage 49 at the upper side of refrigerant distribution pipe 35 and refrigerant passage 49 at the lower side thereof.

The refrigerant flows evenly into many refrigerant passages 49 of refrigerant distribution pipe 35 and flows into each refrigerant evaporation passage 41 from each outlet hole 53 of refrigerant distribution pipe 35. When passing each refrigerant evaporation passage 41 after flowing into each refrigerant evaporation passage 41, the refrigerant is heated by heat-exchanging with air passing around each refrigerant evaporation passage 41 and is evaporated to become gas refrigerant. The gas refrigerant is taken in by compressor 15 from each refrigerant evaporation passage 41 through outlet tank 45 and the outlet pipe.

Conversely, warm air, passing inside duct 2 by the operation of blower 4, is deprived of refrigerant heat and is cooled when passing around plural refrigerant evaporation passages 41 of evaporator 5. Then, the compartment of a vehicle is cooled by the air blown by, for example, face air outlet 22.

In automotive air conditioner 1, as described above, difference in cooling performance between the air passing around refrigerant evaporation passage 41 at the inlet side of inlet tank 44 and the air passing around refrigerant evaporation passage 41 at the back side becomes smaller, thus the cooling efficiency of entire evaporator 5 can be improved. There will be no occurrence of temperature difference between the blow temperature of air passing around refrigerant evaporation passage 41 at the inlet side of inlet tank 44 and the blow temperature of air passing around refrigerant evaporation passage 41 at the back side. Distribution of air blow temperature can be prevented from being uneven. By controlling the size of the inner diameter of throttle hole 37 of nozzle 33, the occurrence of a refrigerant passing noise by throttle hole 37 can be suppressed while keeping throttle hole 37 at a certain size so as to be able to function as a throttle.

Plural experiments have been conducted to investigate how refrigerant distribution performance and cooling performance will change by variously changing eccentricity amount e, which means an amount how much the cross-sectional center of throttle hole 37 is off-centered relative to the cross-sectional center of refrigerant distribution pipe 35 in evaporator 5 shown in FIG. 1.

Figure 6C:
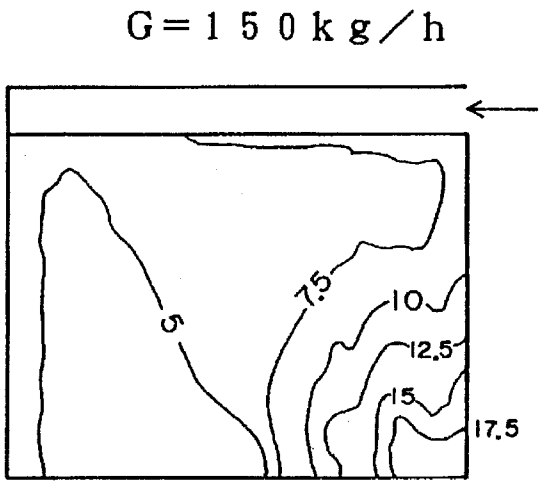
FIGS. 6A–6C are graphical representations of the distribution of blow temperature by the evaporator used in the first embodiment of the present invention.
Figure 6B:
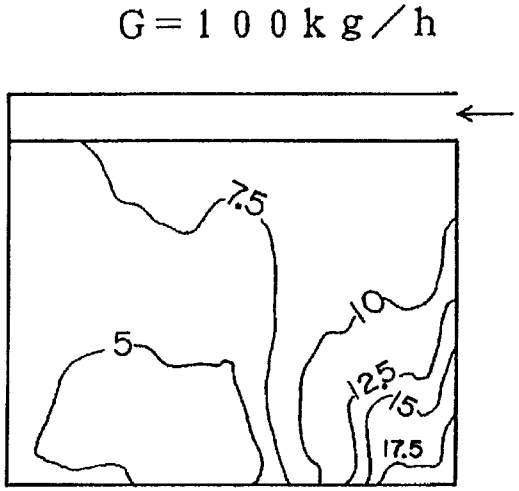
Figure 6A:
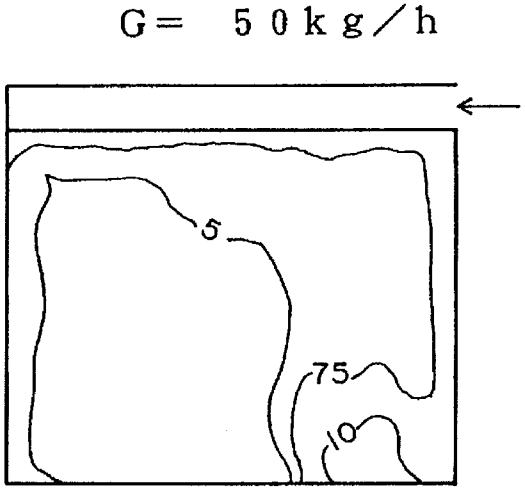
Figure 7C:
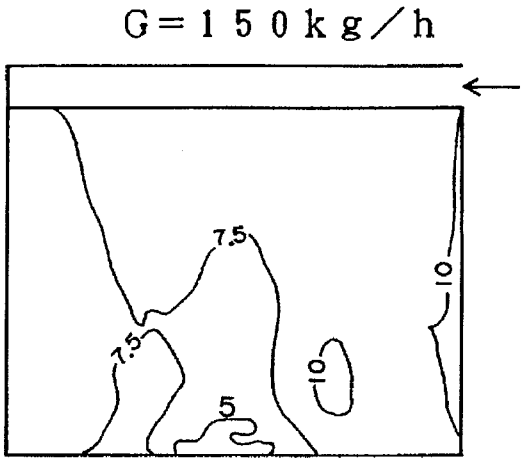
FIGS. 7A–7C are graphical representations of the distribution of blow temperature by the evaporator used in the first embodiment of the present invention.
Figure 7B:
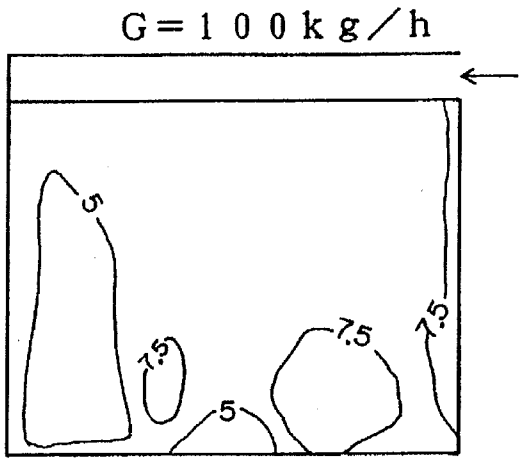
Figure 7A:
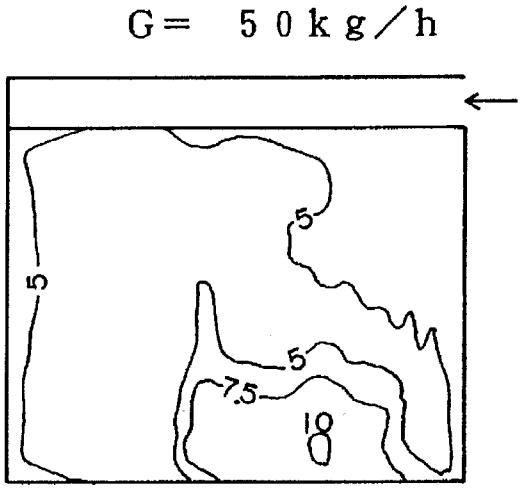

In the first experiment, when the inner diameter d of throttle hole 37 is ϕ 4 mm and the eccentricity amount e is 0 mm, circulation amount of the refrigerant flowing inside refrigerant cycle 14 (evaporator 5) was changed from 50 kg/h to 150 kg/h to investigate the distribution of air blow temperature by evaporator 5. FIGS. 6A–6C show the results of the experiment. Furthermore, when the inner diameter d of throttle hole 37 is ϕ 4 mm and the eccentricity amount e is 0.4 mm, circulation amount of the refrigerant flowing inside refrigerant cycle 14 (evaporator 5) was changed from 50 kg/h to 150 kg/h to investigate the distribution of air blow temperature by evaporator 5. FIGS. 7A–7C show the results of the experiment.

As FIGS. 6A–6C, and 7A–7C show, when evaporator 5 in FIGS. 7A–7C has a cross-sectionally off-centered throttle hole 37 relative to the cross-sectional center of refrigerant distribution pipe 35, there is less fluctuation of blow temperature of the air blown by evaporator 5 from the inlet side to the back side of refrigerant distribution pipe 35 than by evaporator 5 in FIGS. 6A–6C.

In the second experiment, the inner diameter d of throttle hole 37 is fixed at ϕ 4 mm and the eccentricity amount e, i.e., an amount how much the cross-sectional center of throttle hole 37 is off-centered relative to the cross-sectional center of refrigerant distribution pipe 35, was changed from 0 mm to 1.6 mm to investigate the cooling performance of evaporator 5. A graph in FIG. 8 shows the result of the experiment.

Figure 8:
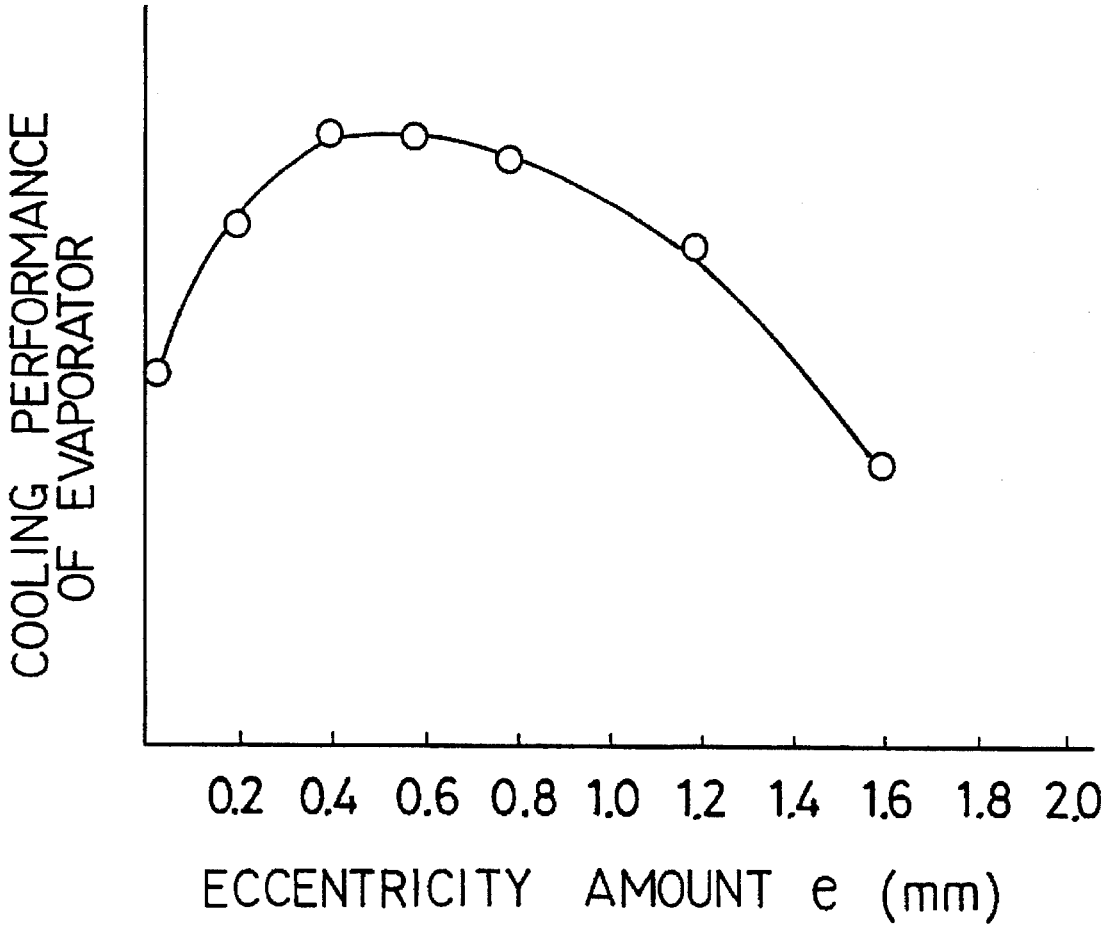
FIG. 8 is a graph showing the relation between the eccentricity amount and cooling performance of the evaporator in the first embodiment of the present invention.

As the graph in FIG. 8 shows, when the eccentricity amount e gets closer to 0 mm or 1.6 mm, the cooling performance sharply declines. However, when the eccentricity amount e is in the range of 0.1 mm to 1.5 mm, the cooling performance is good. Furthermore, the cooling performance is much improved when the eccentricity amount e is from 0.2 mm to 1.2 mm. Specifically, the cooling performance particularly enhances when the eccentricity amount e is from 0.3 mm to 0.8 mm. If the inner diameter d of throttle hole 37 is smaller than ϕ 3 mm, refrigerant passing noise becomes louder. However, if the inner diameter d is larger than ϕ 7 mm, it cannot function as an appropriate throttle, therefore such inner diameter sizes cannot be employed. When the inner diameter d of throttle hole 37 is ϕ 4 mm and the eccentricity amount e is 0.4 mm, both the cooling effect and an effect to lower the refrigerant passing noise show the highest values.

Figure 9:
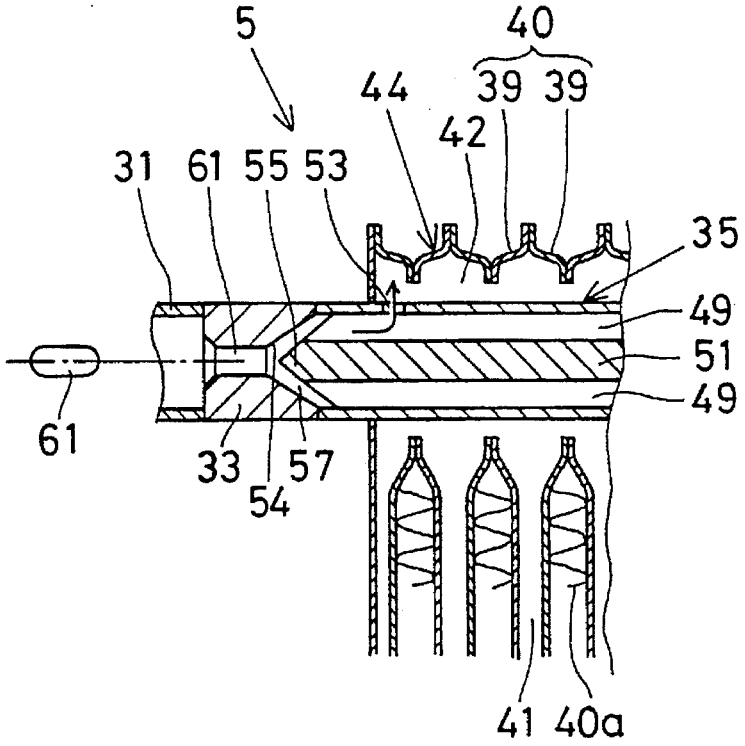
FIG. 9 is a cross-sectional view of a main part of an evaporator used in a second embodiment of the present invention.

FIG. 9 shows a second embodiment of the present invention as well as a main portion of an evaporator. In evaporator 5 in this embodiment, a throttle 61 of nozzle 33 has a horizontally-oblong circle shape. The cross-sectional center of throttle 61 is positioned on the same level as the edge (center) of the convex portion 55 of refrigerant distribution pipe 35.

In the present embodiment, the cross-sectional shape of throttle 61 of nozzle 33 is horizontally oblong circle. Throttle amount can be reduced even in the same cross-sectional area compared with a circle-shaped throttle hole 37. In the gravitation direction, gas and liquid refrigerants are evenly mixed and such condition can be maintained in refrigerant distribution chamber 57 so that the refrigerant can evenly flow into each of plural refrigerant passages 49 of refrigerant distribution pipe 35 from refrigerant distribution chamber 57.

Figure 10:
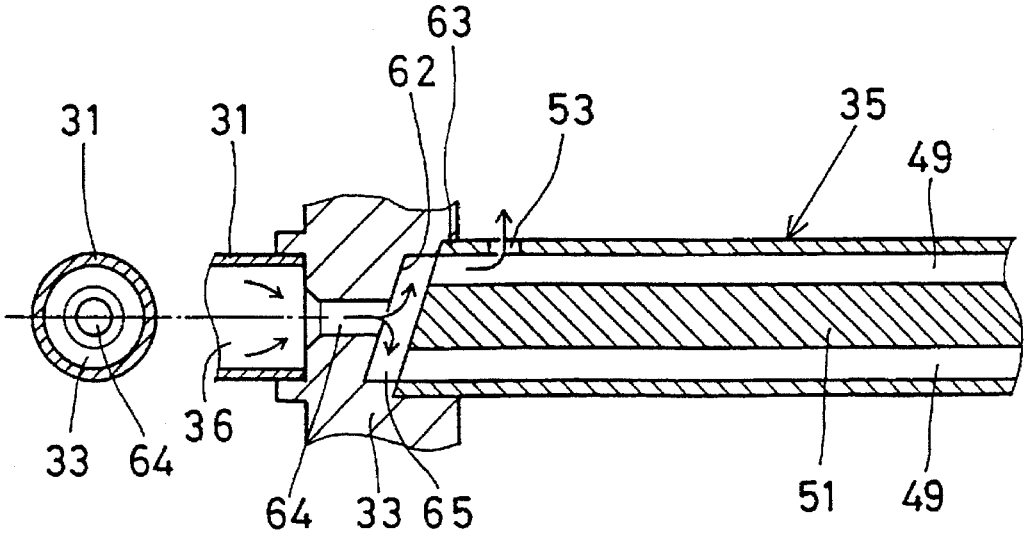
FIG. 10 is a cross-sectional view of a main part of a refrigerant distribution pipe and a nozzle used in a third embodiment of the present invention.

FIG. 10 shows a third embodiment of the present invention as well as a nozzle and a refrigerant distribution pipe. A portion 63 to be engaged with a concave portion 62 formed at the outlet edge of nozzle 33 is formed at the inlet side of refrigerant distribution pipe 35 in the present embodiment. The edge surface of engaged portion 63 and the bottom surface of concave portion 62 incline from the lower part toward the upper part of refrigerant distribution pipe 35 in the flowing direction of the refrigerant. Therefore, a refrigerant distribution chamber 65 is formed between engaged portion 63 of refrigerant distribution pipe 35 and the outlet edge of nozzle 33. Refrigerant distribution chamber 65 evenly distributes the refrigerant flowing out of throttle 64 of nozzle 33 into each refrigerant passage 49 of refrigerant distribution pipe 35.

In the present embodiment, refrigerant distribution chamber 65 is inclined from the lower part of refrigerant distribution pipe 35 toward the upper part thereof, i.e., is inclined in the flowing direction of the refrigerant. Therefore refrigerant flowing out of throttle hole 37 of nozzle 33 can easily flow into refrigerant passages 49 at the upper side of the refrigerant distribution pipe rather than into the refrigerant passages 49 at the lower side of refrigerant distribution pipe 35. Since separation of gas and liquid in the refrigerant inside refrigerant distribution chamber 57 is alleviated, the refrigerant comes to evenly flow into refrigerant passage 49 at both the upper and the lower sides of refrigerant distribution pipe 35. Therefore, there will be a smaller difference between cooling performance of the air passing around refrigerant evaporation passage 41 at the inlet side of inlet tank 44 and cooling performance of the air passing refrigerant evaporation passage 41 at the back side. The entire cooling efficiency of evaporator 5 can thereby be improved.

Figure 11:
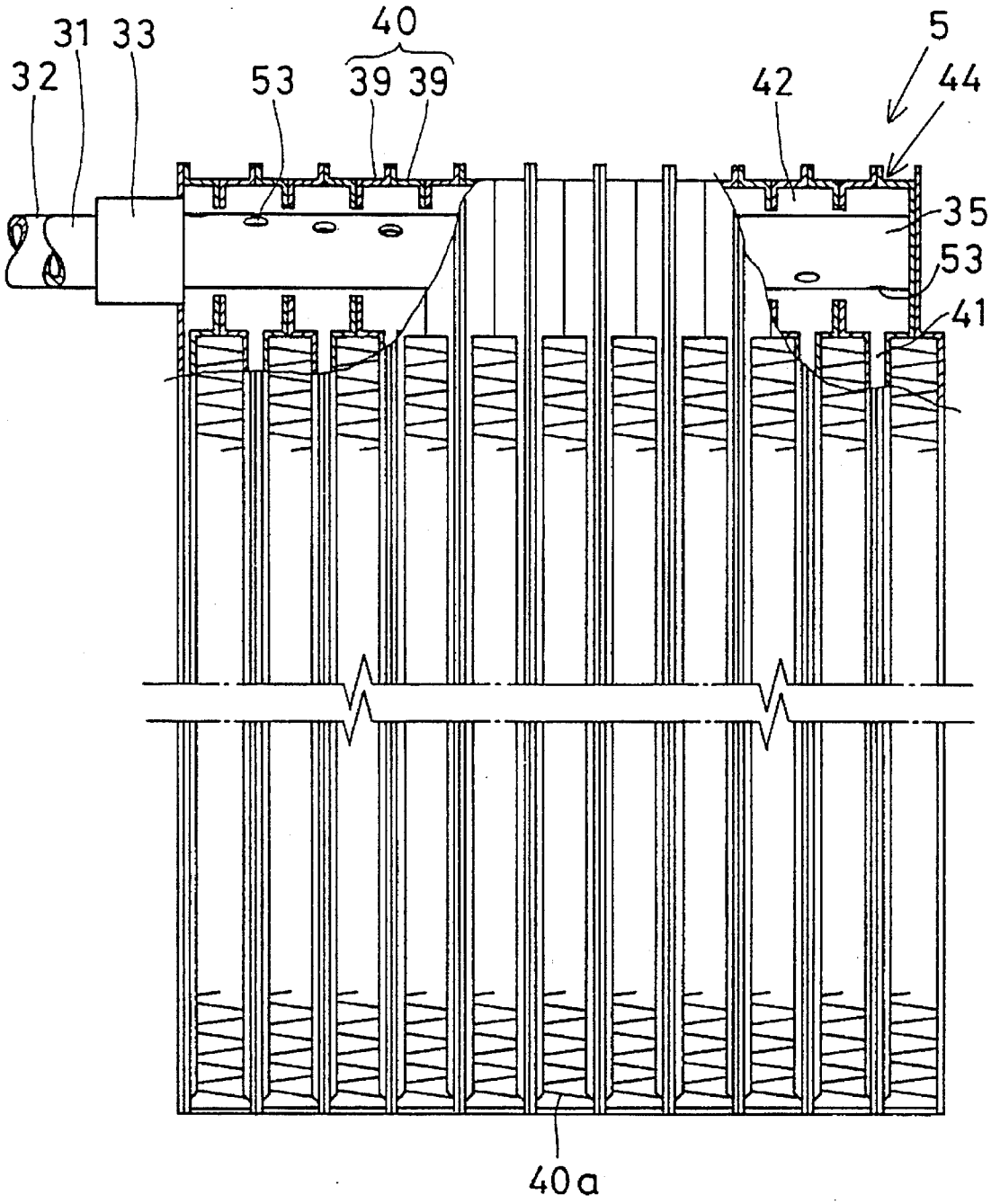
FIG. 11 is a cross-sectional view of an entire structure of an evaporator used in a fourth embodiment of the present invention.
Figure 12:
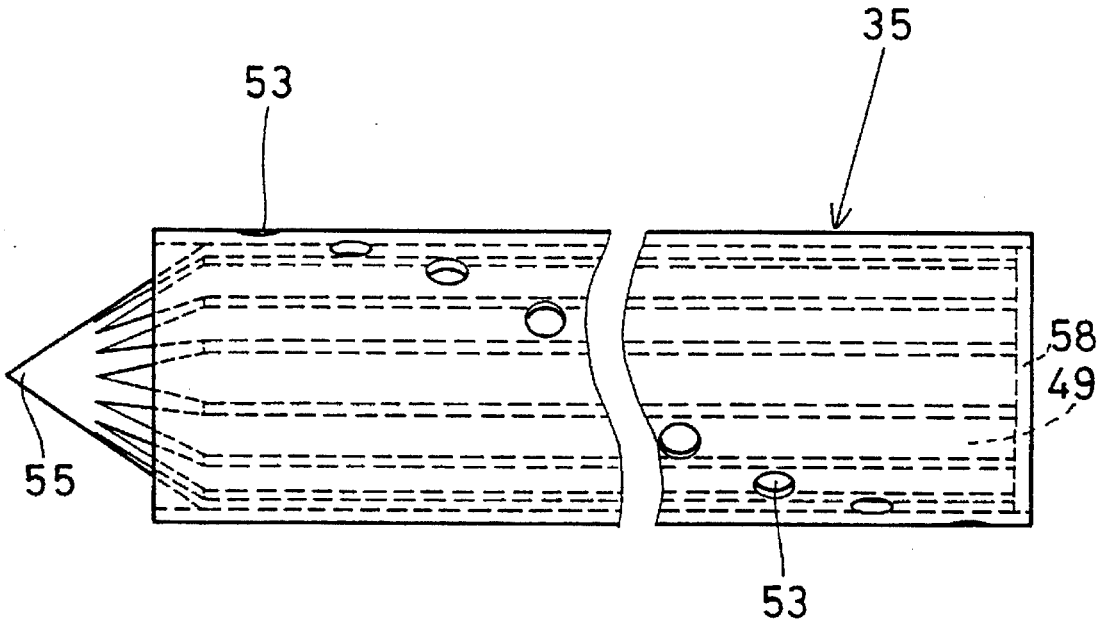
FIG. 12 is a side view of a refrigerant distribution pipe used in the fourth embodiment of the present invention.

FIGS. 11 and 12 show a fourth embodiment of the present invention. FIG. 11 is a view of an entire structure of an evaporator while FIG. 12 is a view of a refrigerant distribution pipe. In this embodiment, as plural outlet holes 53 of refrigerant distribution pipe 35 progressively move from the inlet side to the back side of inlet tank 44, outlet holes 53 are gradually bored lower and lower on the refrigerant distribution pipe 35, i.e., from the inlet side they form a clockwise spiral around the refrigerant distribution pipe 35.

Accordingly, the refrigerant flows from refrigerant passages 49 at the upper part of refrigerant distribution pipe 35 into refrigerant evaporation passage 41 connected to the inlet side of inlet tank 44. The refrigerant flows from refrigerant passage 49 at the lower side of refrigerant distribution pipe 35 into refrigerant evaporation passage 41 connected to the back side of inlet tank 44. Element 32 identifies an outlet pipe.

When the bored positions of plural outlet holes 53 on refrigerant distribution pipe 35 are arranged progressively lower and lower from the inlet side to the back side of inlet tank 44 as shown in the present embodiment, the influence of separation of gas and liquid refrigerant can be offset in refrigerant distribution chamber 57. That is, the refrigerant having a higher dryness fraction (gas rich refrigerant) flows at the upper part of refrigerant distribution chamber 57 while the refrigerant having a lower dryness fraction (liquid rich refrigerant) flows at the lower part of refrigerant distribution chamber 57, and both refrigerants flow into many refrigerant passages 49 of refrigerant distribution pipe 35.

Because exchanged calories in refrigerant evaporation passage 41 depend on the flowing amount of liquid refrigerant, exchanged calories in refrigerant evaporation passage 41 guided by refrigerant passage 49 located at the lower part of refrigerant distribution chamber 57, becomes higher than those in refrigerant evaporation passage 41 guided by refrigerant passage 49 located at the upper part of refrigerant distribution chamber 57. Thus exchanged calories become unequal. The refrigerant is guided from both the lower and upper portions of refrigerant distribution chamber 57 to refrigerant distribution pipe 35. By placing the bored holes of plural outlet holes 53 of refrigerant distribution pipe 35 as described above, the passage length of refrigerant passage 49 at the lower side of refrigerant distribution pipe 35 becomes longer than the passage length of refrigerant passage 49 at the upper side of refrigerant distribution pipe 35. Pressure loss of refrigerant passage 49 at the lower side of refrigerant distribution pipe 35 becomes larger than that of refrigerant passage 49 at the upper side of refrigerant distribution pipe 35.

Therefore, a smaller amount of refrigerant flows in refrigerant passage 49 at the lower side of refrigerant distribution pipe 35 than in refrigerant passage 49 at the upper side of refrigerant distribution pipe 35. A large amount of the refrigerant having relatively high dryness fraction tends to flow into the upper side of refrigerant passage 49 while a small amount of the refrigerant having relatively low dryness fraction tends to flow into the lower side of refrigerant passage 49. Because the refrigerant having high dryness fraction flows a lot but refrigerant having low dryness fraction flows only a little, the flowing amount of liquid refrigerant becomes balanced. The refrigerant is guided to the inlet side of inlet tank 44 from refrigerant passage 49 at the lower side of refrigerant distribution pipe 35 and also is guided to the back side of inlet tank 44 from refrigerant passage 49 at the upper side of refrigerant distribution pipe 35. Heat exchange amount of refrigerant evaporation passage 41 connected to the inlet side of inlet tank 44 can be maintained evenly relative to refrigerant evaporation passage 41 connected to the back side of inlet tank 44. Thus, heat-exchange efficiency of evaporator 5 can be improved as a whole.

Figure 13:
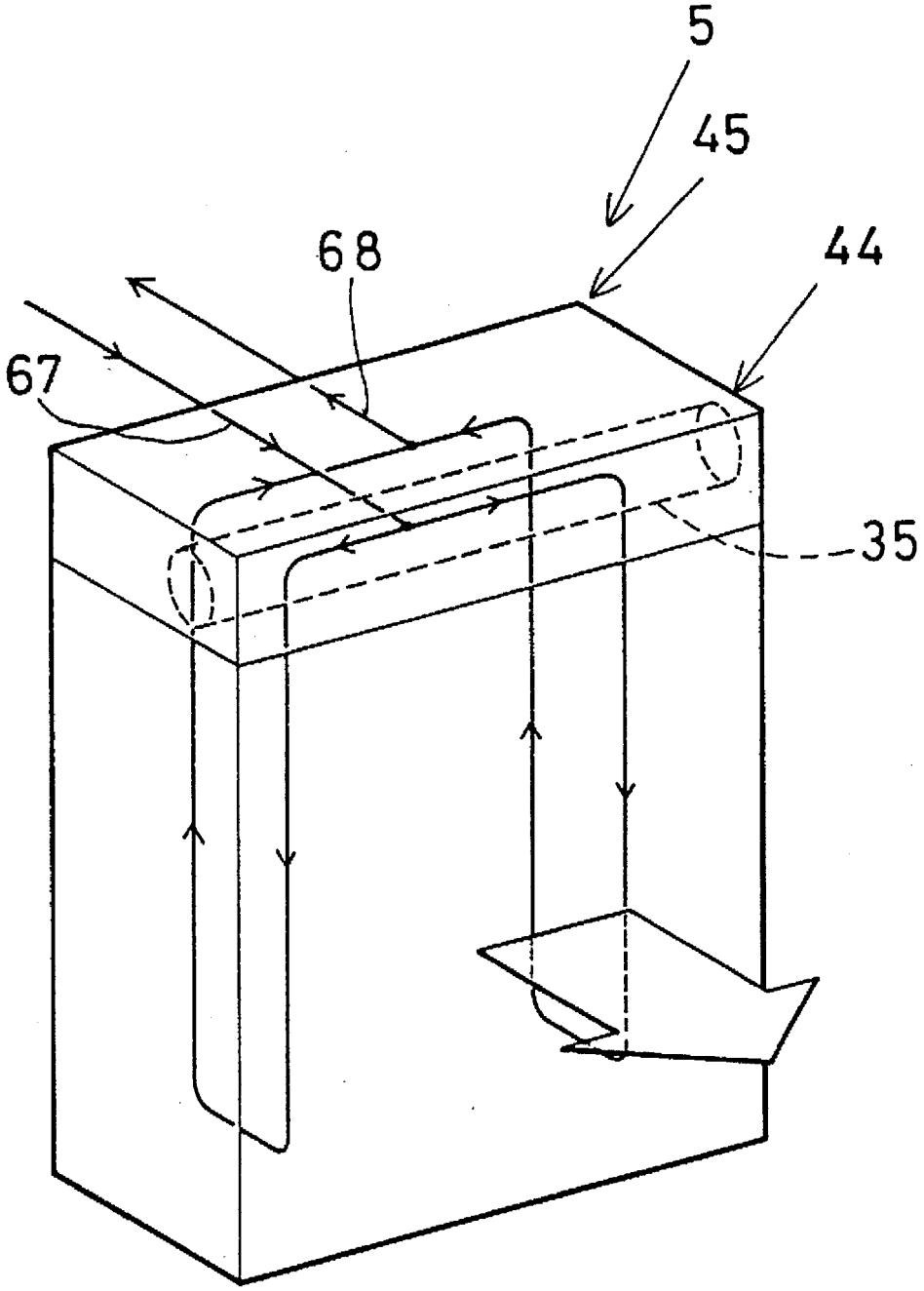
FIG. 13 is a perspective view of the flow of the refrigerant inside an evaporator used in a fifth embodiment of the present invention.

FIG. 13 shows a fifth embodiment of the present invention as well as an evaporator. In this embodiment, a passage 67 to make the refrigerant flow into evaporator 5 and a passage 68 to make the refrigerant flow out of evaporator 5 are disposed at the center in the width-wise direction of evaporator 5, i.e., in this evaporator 5, the refrigerant flows into inlet tank 44 from the center to the side.

Figure 14A:
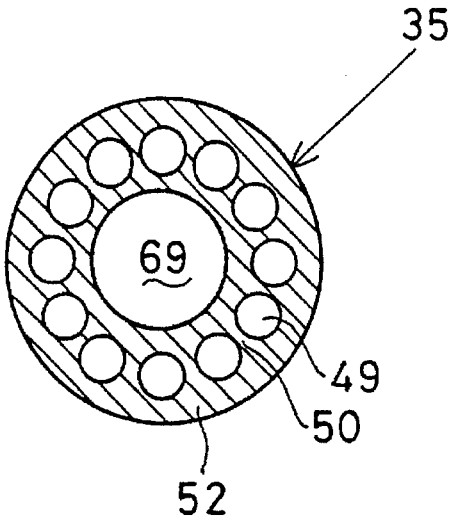
FIGS. 14A–14C are cross-sectional views of modifications of a refrigerant distribution pipe used in a sixth embodiment of the present invention.
Figure 14B:
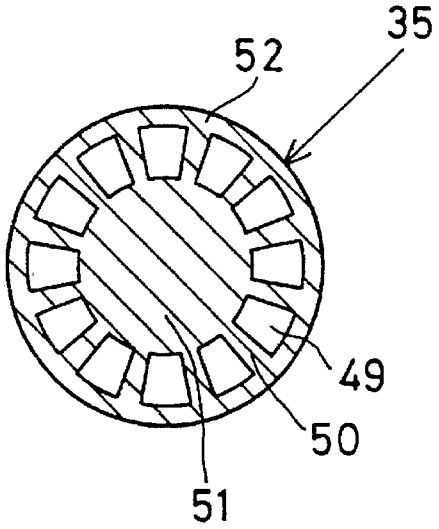
Figure 14C:
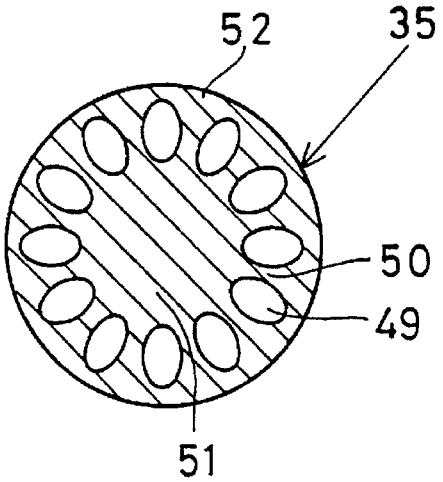

FIGS. 14A–14C show a sixth embodiment of the present invention which is a modified embodiment of a refrigerant distribution pipe inserted into the inlet tank of an evaporator. In this embodiment, the cross-sectional shape of many refrigerant passages 49 of refrigerant distribution pipe 35 is either circular, substantially trapezoid, or oval. Any other shape can be employed as for the cross-sectional shape of many refrigerant passages 49 of refrigerant distribution pipe 35. Refrigerant distribution pipe 35 shown in FIG. 14A has a penetrating hole 69 at the center to lower material cost.

In this embodiment, the present invention is applied to evaporator 5 composing refrigerant cycle 14 of automotive air conditioner 1. However, the present invention can be applied to a refrigerant evaporator composing a refrigerant cycle of an air conditioner for an architectural structure such as an office or a residence. That is, compressor 15 can be actuated by an internal combustion engine or an electric motor of either the direct current or alternating current type. A circular tube plate fin type or a modified shaped tube corrugated fin type and any other type of evaporator (a refrigerant evaporator) 5 may be used.

In this embodiment, inlet tank 44 and outlet tank 45 are disposed at the top of refrigerant evaporation passage 41 of evaporator 5. However, inlet tank 44 and outlet tank 45 may be placed under refrigerant evaporation passage 41 of evaporator 5. A fixed throttle such as nozzle 33 is used as a throttle portion. However, a fixed throttle such as a capillary tube or an orifice or a variable throttle such as an expansion valve may alternatively be used.

In addition, a receiver cycle type refrigerant cycle 14 is used. However, an accumulator cycle type may be used as a substitution. A fixed throttle such as an orifice or a capillary tube can be used instead of expansion valve 18.

Nozzle (a throttle portion) 33 in the first embodiment and refrigerant distribution pipe 35 in the third embodiment or refrigerant distribution pipe 35 in the fourth embodiment can be combined to construct evaporator (a refrigerant evaporator) 5. Nozzle (a throttle portion) 33 in the second embodiment and refrigerant distribution pipe 35 in the third embodiment or refrigerant distribution pipe 35 in the fourth embodiment can be combined to construct refrigerant evaporator 5.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A refrigerant evaporator comprising:

an inlet tank having an inlet side and a back side, said tank having refrigerant flowing therein extending from said inlet side to said back side;

a heat carrier connected to said inlet tank;

plural refrigerant evaporation passages connected in parallel from said inlet side to said back side of said inlet tank, wherein said refrigerant flowing from said inlet tank is heat-exchanged with said heat carrier and evaporated;

a refrigerant distribution pipe inserted from said inlet side to said back side of said inlet tank, said pipe having plural refrigerant passages to distribute said refrigerant flowing inside to said plural refrigerant evaporation passages respectively, said pipe including an upstream side and a center; and a throttle disposed at said upstream side of said refrigerant distribution pipe, said throttle including a center, wherein said center of said throttle is off-centered from said center of said refrigerant distribution pipe.

2. A refrigerant evaporator according to claim 1, wherein said throttle includes an inner diameter and wherein:

3 mm≦d≦7 mm and 0.3 mm≦e≦1.5 mm are satisfied when an inner diameter of said throttle is d, eccentricity amount of said throttle relative to said center of said refrigerant distribution pipe is e.

3. A refrigerant evaporator according to claim 1, wherein said refrigerant distribution pipe includes an upper part and a lower part and wherein:

plural outlet holes are disposed on said refrigerant distribution pipe to make said refrigerant flow out of said plural refrigerant passages to each of said plural refrigerant evaporation passages and are formed progressively from said upper part of said refrigerant distribution pipe to said lower part of said refrigerant distribution pipe from said inlet side to said back side of said inlet tank.

4. A refrigerant evaporator according to claim 1, wherein:

plural outlet holes are disposed on said refrigerant distribution pipe to make said refrigerant flow out of said plural refrigerant passages to each of said plural refrigerant evaporation passages and are formed progressively from an upper part of said refrigerant distribution pipe to a lower part of said refrigerant distribution pipe from said inlet side to said back side of said tank.

5. A refrigerant evaporator comprising:

an inlet tank having an inlet side and a back side, said tank having refrigerant flowing from said inlet side to said back side;

a refrigerant evaporation passage positioned between said inlet side and said back side of said inlet tank;

a refrigerant distribution pipe inserted from said inlet side to said back side of said inlet tank, said refrigerant distribution pipe including an upstream side and a center; and a throttle having a center, said throttle being disposed at said upstream side of said refrigerant distribution pipe such that said center of said throttle is off-centered from said center of said refrigerant distribution pipe.

6. A refrigerant evaporator according to claim 5, further including at least two of said refrigerant evaporation passages, said at least two refrigerant evaporation passages being positioned in parallel.

7. A refrigerant evaporator according to claim 6, wherein said refrigerant distribution pipe has plural refrigerant passages formed therein to distribute said refrigerant flowing inside to said at least two refrigerant evaporation passages.

8. A refrigerant evaporator according to claim 5, further including a heat carrier and wherein refrigerant flowing from said inlet tank is heat-exchanged with said heat carrier and is evaporated.

9. A refrigerant evaporator according to claim 5, wherein:

3 mm≦d≦7 mm and 0.3 mm ≦e≦1.5 mm are satisfied when an inner diameter of said throttle is d, eccentricity amount of said throttle relative to said center of said refrigerant distribution pipe is e.

10. A refrigerant evaporator according to claim 7, wherein:

said refrigerant distribution pipe includes an upper part and a lower part and wherein plural outlet holes are disposed on said refrigerant distribution pipe to make said refrigerant flow out of said plural refrigerant passages to each of said plural refrigerant evaporation passages and are formed progressively from said upper part of said refrigerant distribution pipe to said lower part of said refrigerant distribution pipe from said inlet side to said back side of said inlet tank.

* * * * *

UNITED STATES PATENT AND TRADEMARK OFFICE

CERTIFICATE OF CORRECTION

PATENT NO. : 5,651,268

DATED : July 29, 1997

INVENTOR(S) : Yasukazu Aikawa et al

It is certified that error appears in the above-identified patent and that said Letters Patent is hereby corrected as shown below:

Title page, [73] Assignee, "Nippondeso Co., Ltd."

should be -- Nippondenso Co., Ltd. --

Signed and Sealed this

Tenth Day of February, 1998

*Attest:*

*Attesting Officer*

BRUCE LEHMAN

*Commissioner of Patents and Trademarks*